US010077148B2

(12) United States Patent
Goettke

(10) Patent No.: US 10,077,148 B2
(45) Date of Patent: Sep. 18, 2018

(54) METHOD FOR DEVELOPING A TABLET DISPENSER, AND A TABLET DISPENSER

(71) Applicant: RPC Bramlage GmbH, Lohne (DE)

(72) Inventor: Sabine Goettke, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 14/388,360

(22) PCT Filed: Feb. 12, 2013

(86) PCT No.: PCT/IB2013/051134
§ 371 (c)(1),
(2) Date: Sep. 26, 2014

(87) PCT Pub. No.: WO2013/114348
PCT Pub. Date: Aug. 8, 2013

(65) Prior Publication Data

US 2015/0076170 A1 Mar. 19, 2015

(30) Foreign Application Priority Data

Feb. 1, 2012 (DE) ..... 10 2012 100 827

(51) Int. Cl.
*B65D 83/04* (2006.01)

(52) U.S. Cl.
CPC ..... *B65D 83/0409* (2013.01); *Y10T 29/4984* (2015.01)

(58) Field of Classification Search
CPC ..... B65D 83/04
See application file for complete search history.

(56) References Cited

U.S. PATENT DOCUMENTS

| | | | | |
|---|---|---|---|---|
| 2,683,554 | A | 7/1954 | Mulhauser, Jr. | |
| 6,206,235 | B1 * | 3/2001 | Green | B65D 83/0409 221/204 |
| 8,459,498 | B2 * | 6/2013 | Giraud | A47F 1/10 221/251 |
| 2003/0234260 | A1 | 12/2003 | Giraud | |
| 2009/0194556 | A1 | 8/2009 | Klein et al. | |

FOREIGN PATENT DOCUMENTS

| | | | |
|---|---|---|---|
| EP | 0 002 403 | A1 | 6/1979 |
| EP | 1 052 189 | A2 | 11/2000 |

OTHER PUBLICATIONS

International Search Report of PCT/IB2013/051134, dated Jun. 12, 2013.
International Preliminary Report on Patentability of PCT/IB2013/051134, dated Aug. 5, 2014.

* cited by examiner

*Primary Examiner* — Gene O Crawford
*Assistant Examiner* — Ayodeji T Ojofeitimi
(74) *Attorney, Agent, or Firm* — Collard & Roe, P.C.

(57) ABSTRACT

The invention relates firstly to a method for constructing a tablet dispenser, and also a tablet dispenser (1), for the dose-controlled issue of tablets (35), having a housing (2) and a dispensing part (3) that is insertable in the housing (2), wherein the dispensing part (3) has a dispensing chute (22) and a metering part (44) that is movable relative to the dispensing chute against the force of a return spring (19). In order to achieve favorable loading of the return spring, it is suggested to provide a tensioning part (13), which is moved into an area previously occupied by the unbiased return spring (19), preferably as the dispensing part (3) is inserted in the housing (2).

20 Claims, 7 Drawing Sheets

5
1
2
4
43
8
6
32
22
13
7
9
40
25
41
42
39
37
35
36
38

5
1
2
4
43
8
6
32
22
13
7
9
40
25
41
42
39
37
35
36
38

METHOD FOR DEVELOPING A TABLET DISPENSER, AND A TABLET DISPENSER

CROSS REFERENCE TO RELATED APPLICATIONS

This application is the National Stage of PCT/IB2013/051134 filed on Feb. 12, 2013, which claims priority under 35 U.S.C. § 119 of German Application No. 10 2012 100 827.2 filed on Feb. 1, 2012, the disclosure of which is incorporated by reference. The international application under PCT article 21(2) was not published in English.

The invention relates firstly to a method for constructing a tablet dispenser for the dose-controlled issue of tablets, having a housing and a dispensing part that is insertable in the housing, wherein the dispensing part has a dispensing chute and a metering part that is movable relative to the dispensing chute against the force of a return spring.

The invention further relates to a tablet dispenser having the material features described in the preceding.

Various aspects of the tablet dispensers of such kind are already known. Reference is made to EP 1 052 189 A2, for example. In the tablet dispenser disclosed therein, the dispensing chute is constructed as a single part with the return spring. When the dispensing part is being inserted in the housing, the attached parts are moved toward one another, thereby displacing and pretensioning the return spring. However, this displacement may also be initiated during transportation and even immediately after demoulding. Early loading of the spring, before the dispensing part is inserted in the housing, can affect the spring force unfavourably.

Based on the prior art as described, a first aspect of the invention addresses the problem of devising a method for designing a tablet dispenser and also a tablet dispenser in which it is possible apply a favourable load to the return spring in predictable manner.

According to a first inventive thought, one possible solution to the object is realised with a method in which a tensioning part, which is also provided with the tablet dispenser, is moved into an area of a space occupied by the unbiased return spring as the dispensing part is inserted in the housing. A further possible solution to the object is achieved materially with a tablet dispenser in which a tensioning part is provided, which tensioning part is preferably movable into an area of a space occupied by the unbiased return spring as the dispensing part is inserted in the housing After the injection operation, the return spring extends in a space occupied physically thereby under no tension. At a determinable point in time, preferably during insertion and not before, a tensioning part is introduced into this space, preferably some of this space, thereby forcing corresponding displacement of the return spring so that pretension is generated in the return spring. Pretension in the return spring is advantageous and desirable, because this conveys the feel of a properly functioning device when the tablet dispenser is used subsequently. It is also assured that the metering part is in the desired, unactuated position relative to the dispensing chute. In this position, the dispensing opening, which follows on from the bottom of the dispensing chute, is closed. It is not possible for tablets to fall out of the tablet dispenser unintentionally.

The tensioning part may be designed in various ways. On the one hand, it may be realised in the form of a preferably inwardly directed projection conformed on the housing wall. It may also be assured by a projection that is movable relative to the housing wall and which is then necessarily moved preferably inwardly as the insertion takes place. The projection may also be designed to be deliberately shiftable into the biased position after the insertion as well, by means of a non-returnable detent, for example.

A section of the spring, for example a favourably constructed free end of the spring, may abut with or be actively moved by the tensioning part during the insertion. In both cases, the net result is that the tensioning part is moved into the space that was previously occupied by the unbiased spring. Such a tensioning projection may also be constructed as part of the dispensing part itself. In this case, the tensioning part itself is movable relative to the dispensing chute and/or the metering part.

Additional features of the invention are described and/or presented in the following and in the description of the figures and the drawing, often in their preferred association with the previously explained concepts, but they may also be of significance in association with only one or multiple individual features as described or drawn here, or independently or in a different overall concept.

Accordingly, it is preferable if, when in a transportation condition such as exists after demoulding from a plastic injection moulding machine, or into which it is placed after demoulding from the plastic injection moulding machine, the dispensing part equipped with the return spring has the return spring in a concealed position. In this context, the return spring is shielded in such manner that it cannot be placed under stress even when the dispensing parts are filled. This may be achieved for example with a cage structure which surrounds the return spring such that no parts of another dispensing part are able to penetrate far enough to come into contact with the return spring. At all events, a plate-like structure may also be provided on the underside to shield the return spring underneath. Walls, and/or a roof may be provided to enclose the return spring.

It is further preferably provided that the dispensing part consists of two or more subsections, which, although preferably produced together as a single plastic injection moulded part, are in a transportation position with respect to one another after demoulding. In the transportation position, subsections are preferably locked together. This locking arrangement is preferably also designed to be inseparable, that is to say irreversible without destruction of the parts.

The subsections may be attached to each other so as to be pivotable about a vertical axis with reference to the completely assemble tablet dispenser. In particular, one of the subsections may include the return spring and a first shielding wall therefor, extending outside, particularly radially outside said return spring, and more preferably also a part of the dispensing chute, preferably the part that forms the closure on the bottom of the dispensing chute when in the unactuated position and which has moved one or more of the tablets to be dispensed into the dispensing position when in the actuated position. This is preferably also a gate mechanism having a passthrough opening, wherein in the unactuated position the passthrough opening is closed at the bottom by a further section of the dispensing part, which is preferably formed on the other subsection, and in the actuated position is aligned with an opening that is preferably also fashioned on the other subsection.

It is further preferred if a retaining part is also constructed on the subsection that comprises said gate mechanism, and which moves into the dispensing chute upon actuation, thereby preventing additional tablets from slipping after the required tablets, and thus reducing the load on the tablet stack, so that the tablet to be delivered can be dispensed more easily.

Preferably in the upper area of the other subsection, a more preferably V-shaped reserve space bottom is formed and creates a support edge that cooperates with an internal surface of the housing when the device is assembled. The bottom delivers the tablets for dispensing to the dispensing chute by inclining them appropriately. The tablet chute itself is preferably also conformed in this second subsection, with the exception of said parts that are conformed in the other subsection.

It is further preferred that the tensioning part move in a horizontal plane and/or that the return spring is aligned at least substantially in a horizontal plane. In this case, the return spring itself is constructed with a certain vertical thickness. However, the lengthwise extension of the return spring is in the horizontal direction. Said horizontal plane is considered to be relative to a midline or at any rate a plane in a lengthwise direction that passes through the return spring.

In a further preferred variant, the tensioning part may be attached to the dispensing part or the housing via a predetermined breaking point that is created when the part is manufactured. This predetermined breaking point is only broken during the act of inserting the dispensing part in the housing.

In this way, the tensioning part is permitted to move, and the tensioning part moves into the area that was occupied by the spring when under no tension, as described in the preceding.

The tensioning part is also preferably attached to the dispensing part or the housing via a hinge section. Thus, the tensioning part remains connected to the dispensing part via the hinge section even after the predetermined breaking point has become separated. It may thus be moved accordingly in the manner of a bending relative to the dispensing part.

The dispensing part may also have a layout corresponding to an internal free cross section of the housing, wherein however, in the manufactured state the tensioning part is arranged to protrude beyond said layout. As the tensioning part protrudes beyond this layout, the outer boundary of the internal free cross section of the housing, it is forced to move inward during the insertion operation. For this purpose, the outer side thereof has corresponding inclined surfaces, which enable advantageous cooperation with the matching edge of the housing. During the insertion, the tensioning part must therefore be deflected inwards, so that said predetermined breaking points are perforated and the tensioning part, also preferably, is able to pivot about the hinge connection that remains.

It is further preferred that the housing has an oval internal free cross section.

In the following, the invention will be explained in greater detail with reference to the accompanying drawing, in which only one embodiment is represented for exemplary purposes. In the drawing.

Figure 1:
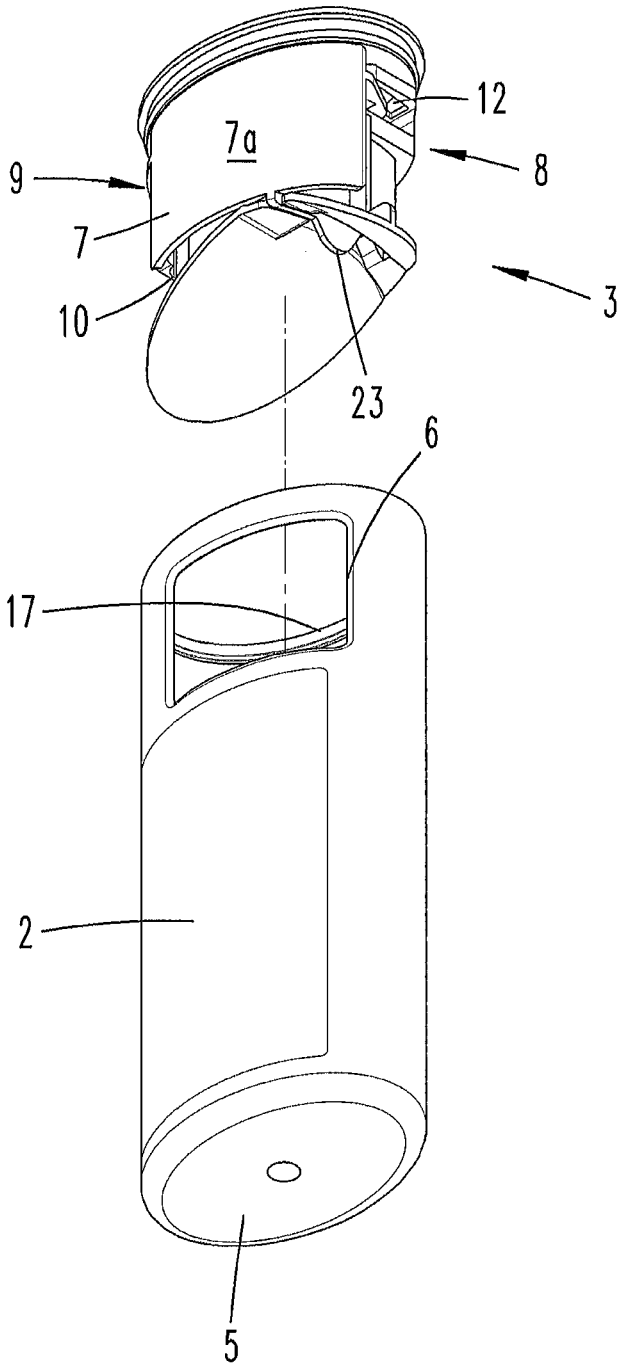
FIG. 1 shows the tablet dispenser before the housing is assembled with the dispensing part.
Figure 9:
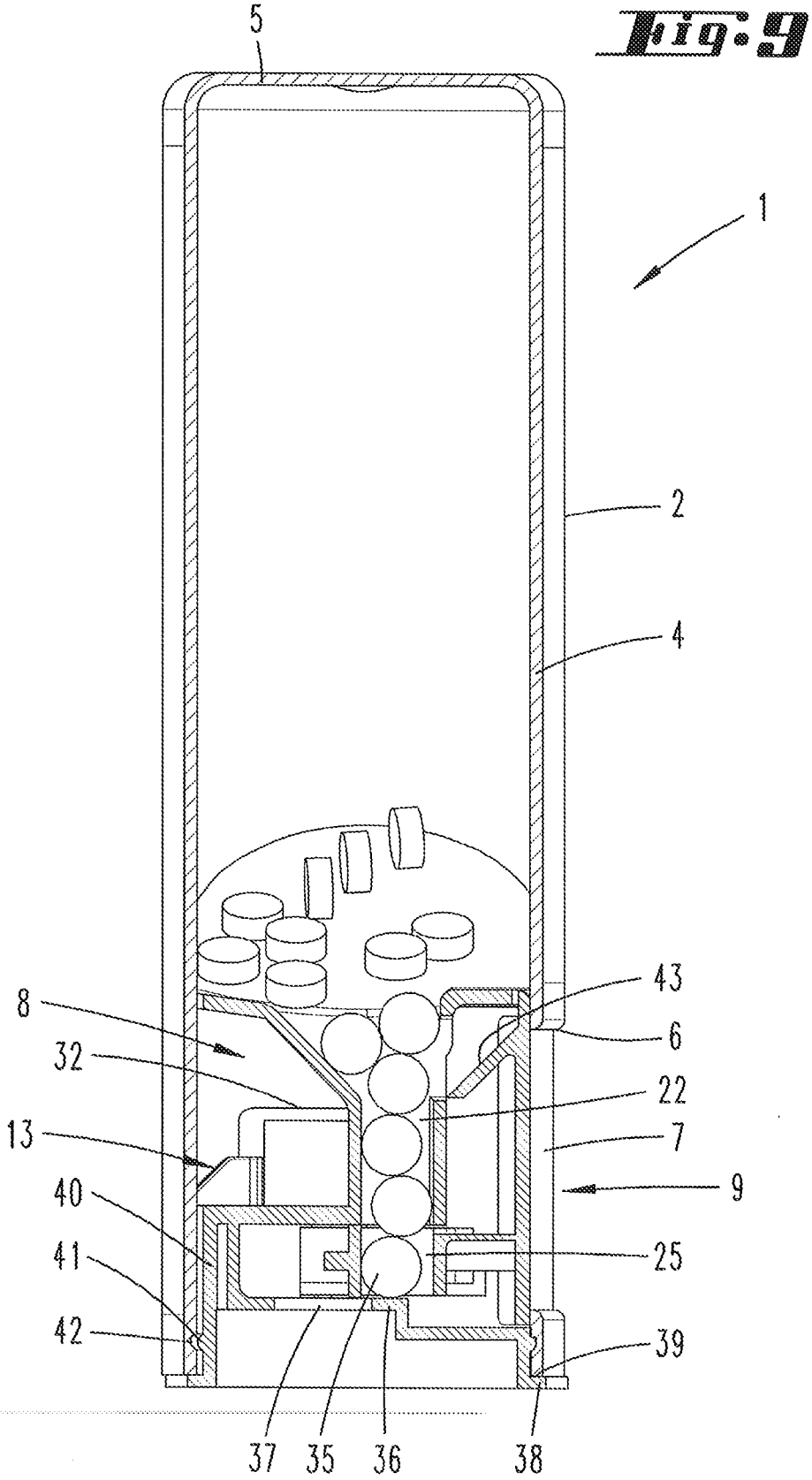
FIG. 9 is a cross section through the dispenser in the unactuated position.

Firstly with reference to FIG. 1, a tablet dispenser 1 is described and illustrated before the assembly of a housing 2 and a dispensing part 3. In the embodiment and preferably, housing 2 is constructed with an oval cross section. The upper area thereof comprises a housing roof 5, which is integral with a housing wall 4, as is also shown in FIG. 9. In the condition prior to assembly as shown in FIG. 1, housing 2, which correspondingly forms a reserve chamber, is filled with tablets—not shown in the figure.

Housing 2 further comprises an actuation window 6. Actuation window 6 may also be a flexible area that is constructed integrally with or fastened to housing wall 4. Preferably and in the exemplary embodiment, however, it is a passthrough opening. An actuating area 7 remains clear on actuating part 7 in said passthrough opening after assembly.

Figure 2:
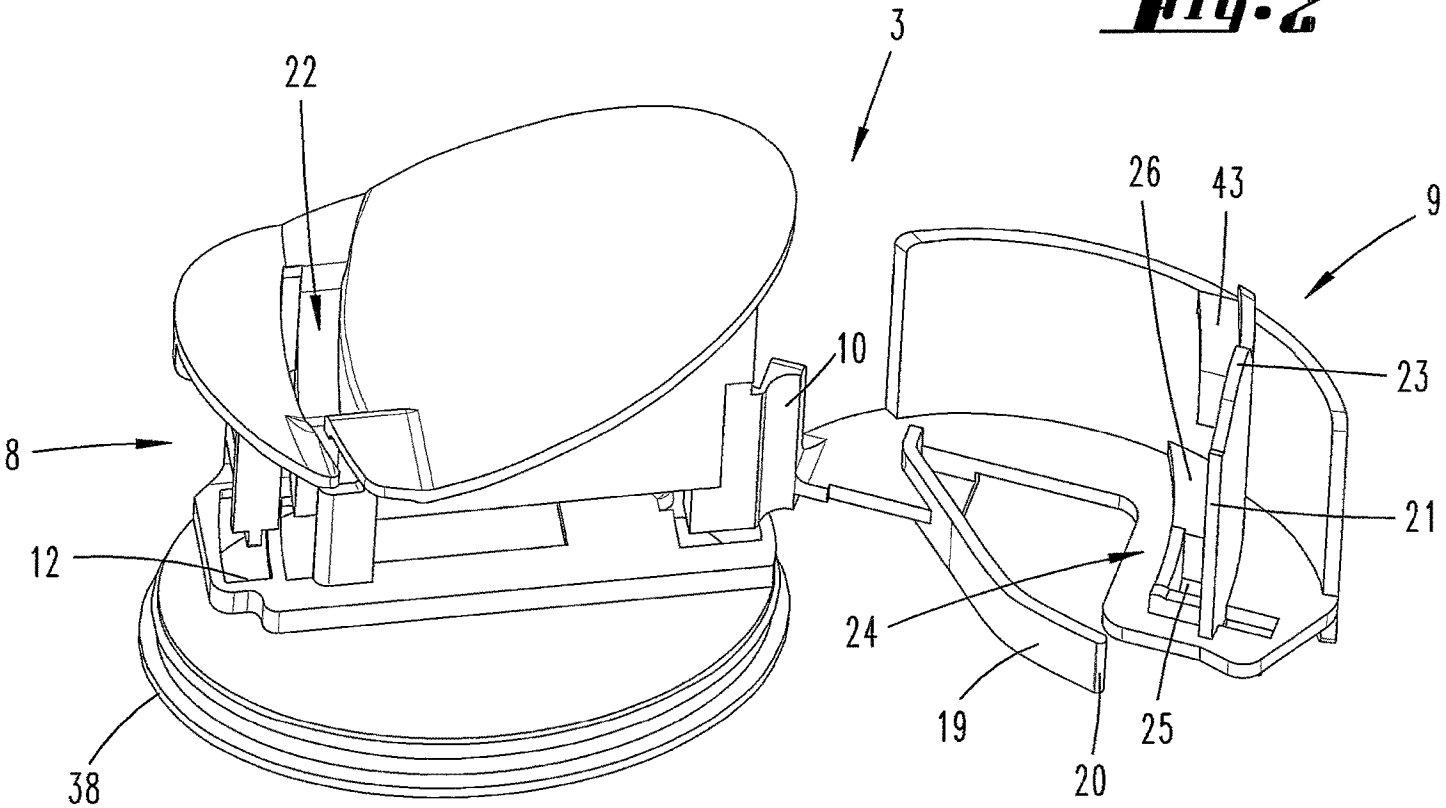
FIG. 2 shows the dispensing part in the injection moulding condition.
Figure 3:
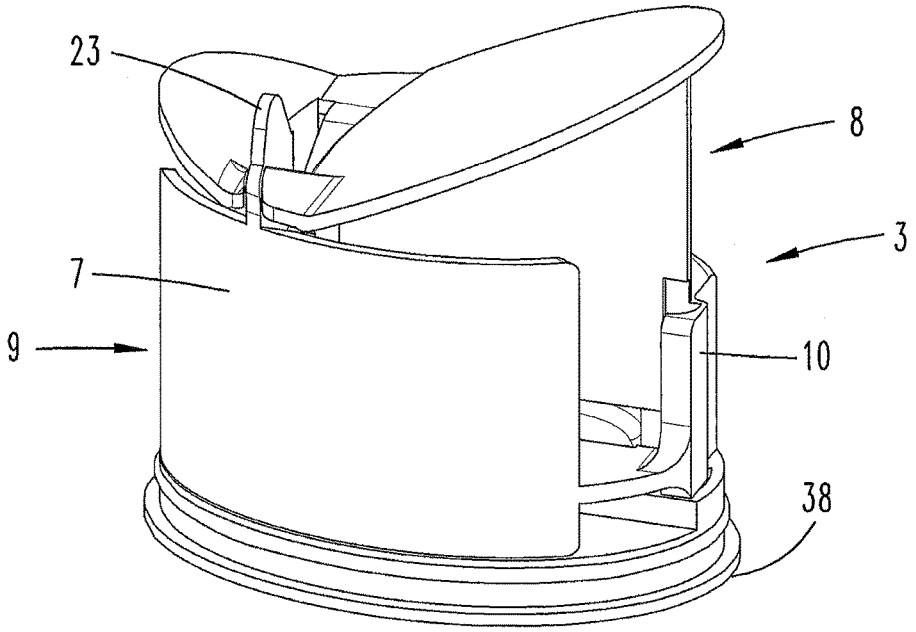
FIG. 3 shows the dispensing part in the locked condition of the transportation position.

FIG. 2 shows dispensing part 3 in the injection moulding condition. It comprises two subsections 8 and 9, which are pivotable toward each other by means of a hinge joint 10. In the injection moulding condition, they are in the open state as shown in FIG. 2, and, preferably while inside the injection moulding machine or immediately thereafter, they are subsequently brought into a locked state as shown in FIG. 3. In this locked state, a locking lug 11, see also FIG. 6 on subsection 9 has also engaged in engaging aperture 12 in subsection 8. As is apparent from the view in FIG. 4, a tensioning part 13 is also formed on subsection 8. Tensioning part 13 is connected pivotably to subsection 8 via a hinge area 14 and in the moulding condition is also attached to subsection 8 via one or more predetermined breaking points 15, two such points being shown in the exemplary embodiment. Hinged area 14 on and predetermined breaking points 15 are formed on opposite ends of pensioning part 13 with reference to a horizontal plane. When dispensing part 3 is inserted in housing 2, predetermined breaking points 15 are pushed inward by the abutment of one or, as in the exemplary embodiment, multiple protruding areas 16 onto a lower housing edge 17, which in turn causes the whole tensioning part to be shifted inwards. In so doing, predetermined breaking points 15 are broken and the whole of tensioning part 13 pivots through pivoting range 14. Pivoting range 14 accordingly has a vertical pivot axis.

Preferably and as shown in the exemplary embodiment, protrusion areas 16 are constructed integrally and as a single part with tensioning part 13.

In detail, protrusion areas 16 are conformed on ribs that protrude outwardly toward the housing wall in the assembled state. As is more evident in the detail, the ribs have an introduction area 18 on top, which functions as an insertion bevel and enables the described deflection during assembly.

Figure 5:
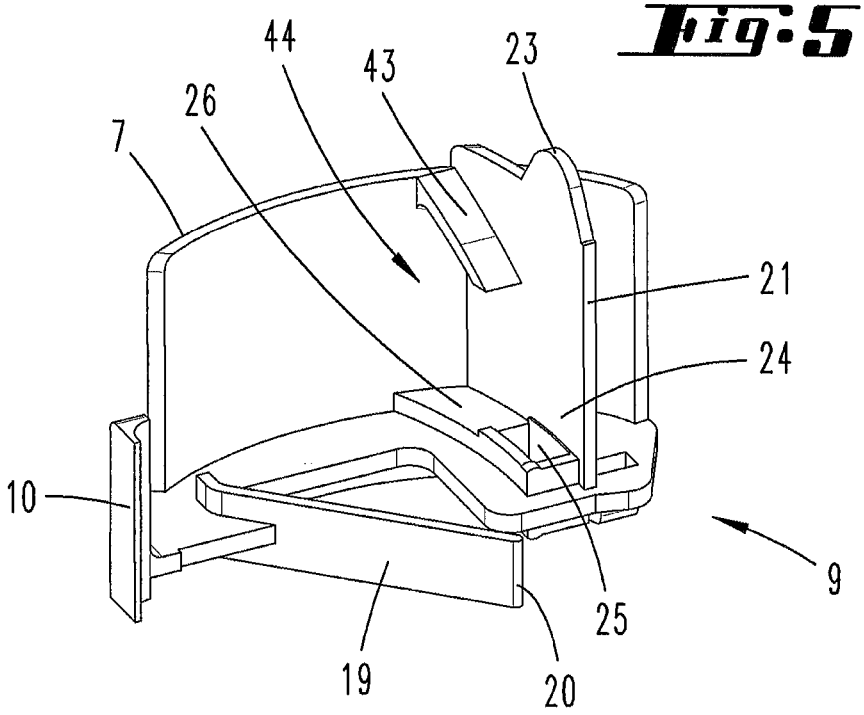
FIG. 5 is an angled view from above of a section of the dispensing part.

In FIG. 5, subsection 9 is shown as a separate part for illustrative purposes, but in general it may also be produced as a single part, in which case a preferably dual locking engagement is provided at both corresponding end areas.

Subsection 9 comprises return spring 19. Return spring 19 is created in the form of a tab, vertically relative to a tab plane. It has a free end 20.

Subsection 9 also forms a metering part 44. Metering part 44 generally ensures the metered delivery of one tablet (or a predetermined number thereof) when the dispensing mechanism is actuated. Metering part 44 may be of various designs. The essential feature is that the dispensing chute is opened for use upon actuation and that the dispensing chute is blocked to prevent inadvertent use when it is not actuated.

Figure 4:
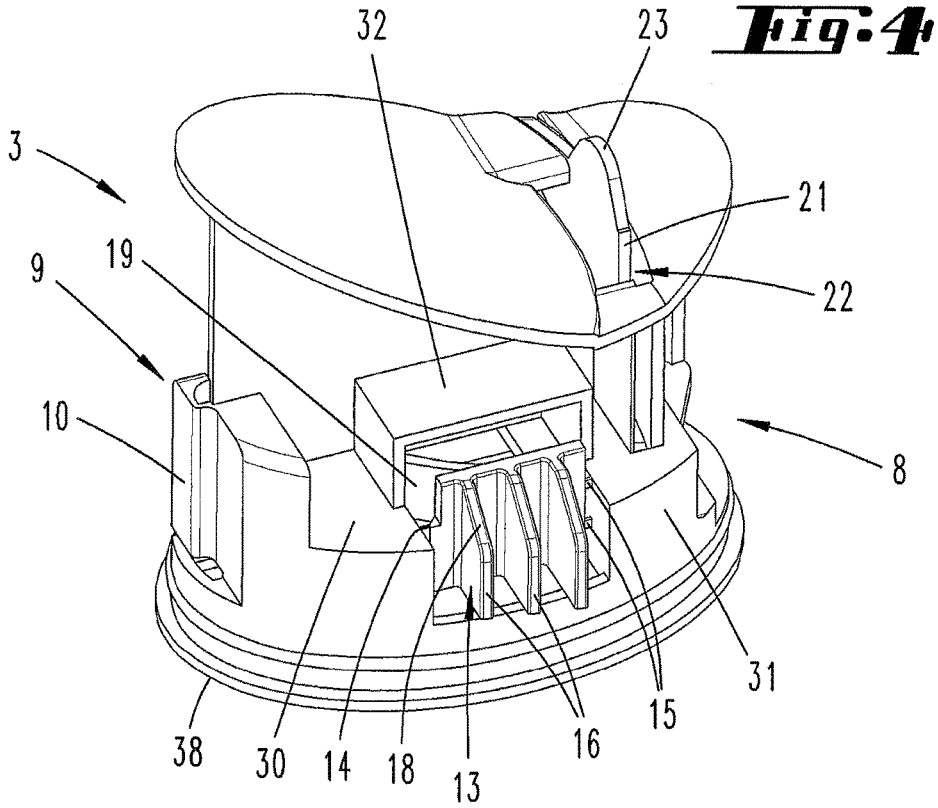
FIG. 4 is a perspective rear view of the dispensing part of FIG. 3.

In the embodiment, metering part (44) has an extension wall 21, which in the assembled state has been extended into dispensing chute 22, as shown in FIG. 4. It is flush with the side of a vertical boundary wall of dispensing chute 22. Cam section 23 projects above an upper opening of dispensing chute 22 to ensure that when actuating section 7 is moved, the tablet reserve located above said section remains mobile.

A locking part 43 is also conformed on subsection 9, and displaces a subsection of the dispensing chute upwards during actuation, to prevent the tablets moving up in the stack from placing pressure on the tablet that is to be dispensed.

In addition, a dispensing gate mechanism 24 is formed in subsection 9, at the foot of extension wall 21. In detail, dispensing gate mechanism 24 has a dispensing aperture 25 and a closing section 26 located before the aperture in the direction of shift during dispensing.

Figure 6:
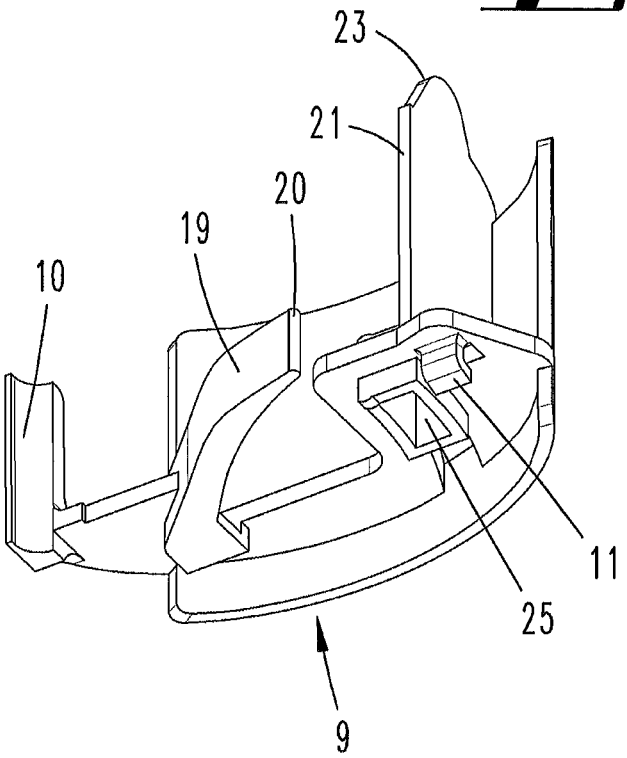
FIG. 6 shows the section of FIG. 5 in an angled view from below.

Said details are visible in greater detail in the perspective view from below according to FIG. 6.

Figure 7:
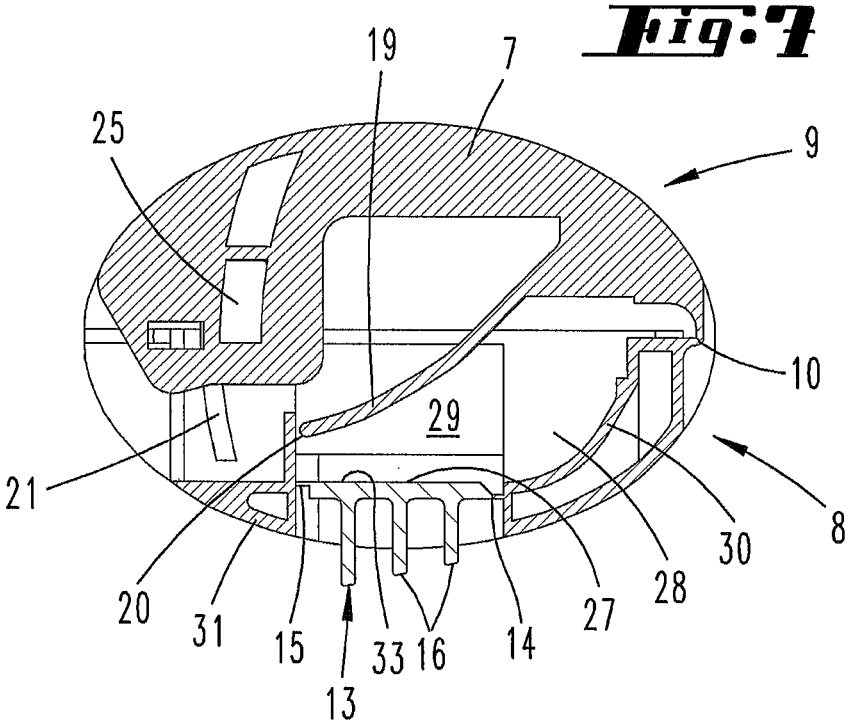
FIG. 7 is a view of the locked dispensing part from below.

As is apparent from the illustration of FIG. 7, when dispensing part 3 is assembled, that is to say engaged, return spring 19 is arranged at a distance from a facing surface 27 of tensioning part 13. At the same time, the underside thereof is shielded by a bottom 28, in which only a relatively small window 29 is created, and which leaves the front end area of return spring 19 visible. The return spring is also shielded laterally by actuating part 7 on the one side and tensioning part 13 on the other side, as well as by housing sections 30, 31 and a roof area 32 (see also FIG. 4) when dispensing part 3 is in this condition, before it is inserted in housing 2. It is thus located in a concealed position.

Figure 8:
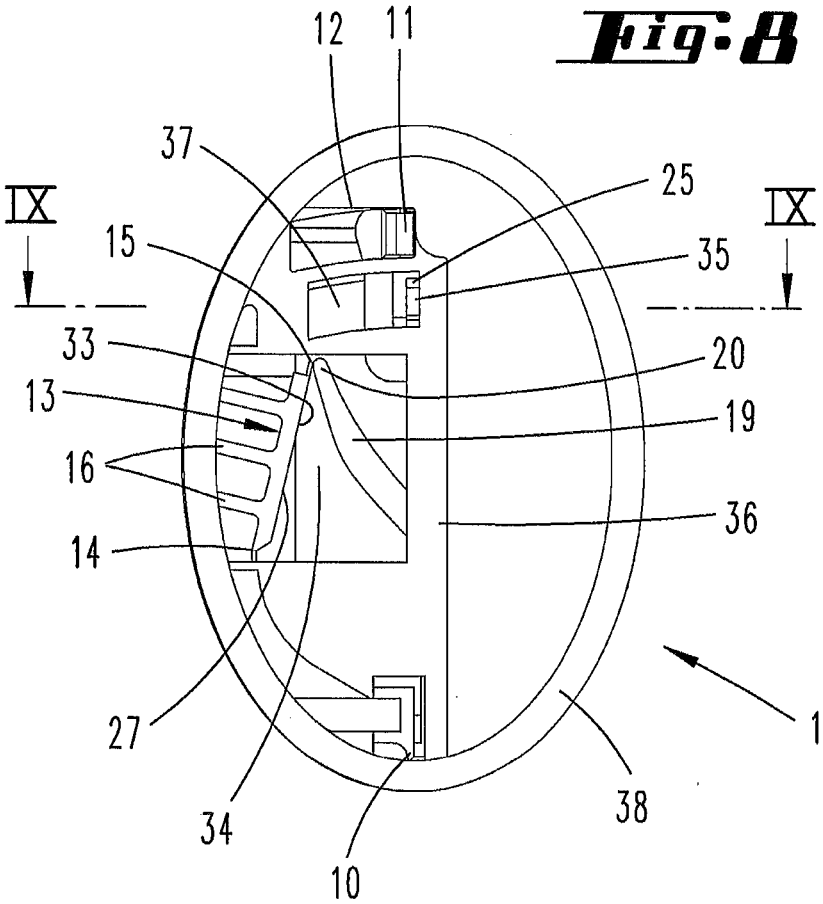
FIG. 8 is the view according to FIG. 7 with the dispenser assembled.

When dispensing part 3 has been inserted in housing 2, as shown in FIG. 8, tensioning part 13 is slid inwards as described, by the breaking of predetermined breaking points 15. Inner surface 33 of tensioning part 13 cooperates visibly with free end 20 of return spring 19. Tensioning part 13 moves into the space previously occupied by the unbiased return spring, or a part 34 thereof.

Consequently, return spring 19 is under constant pretension.

Figure 10:
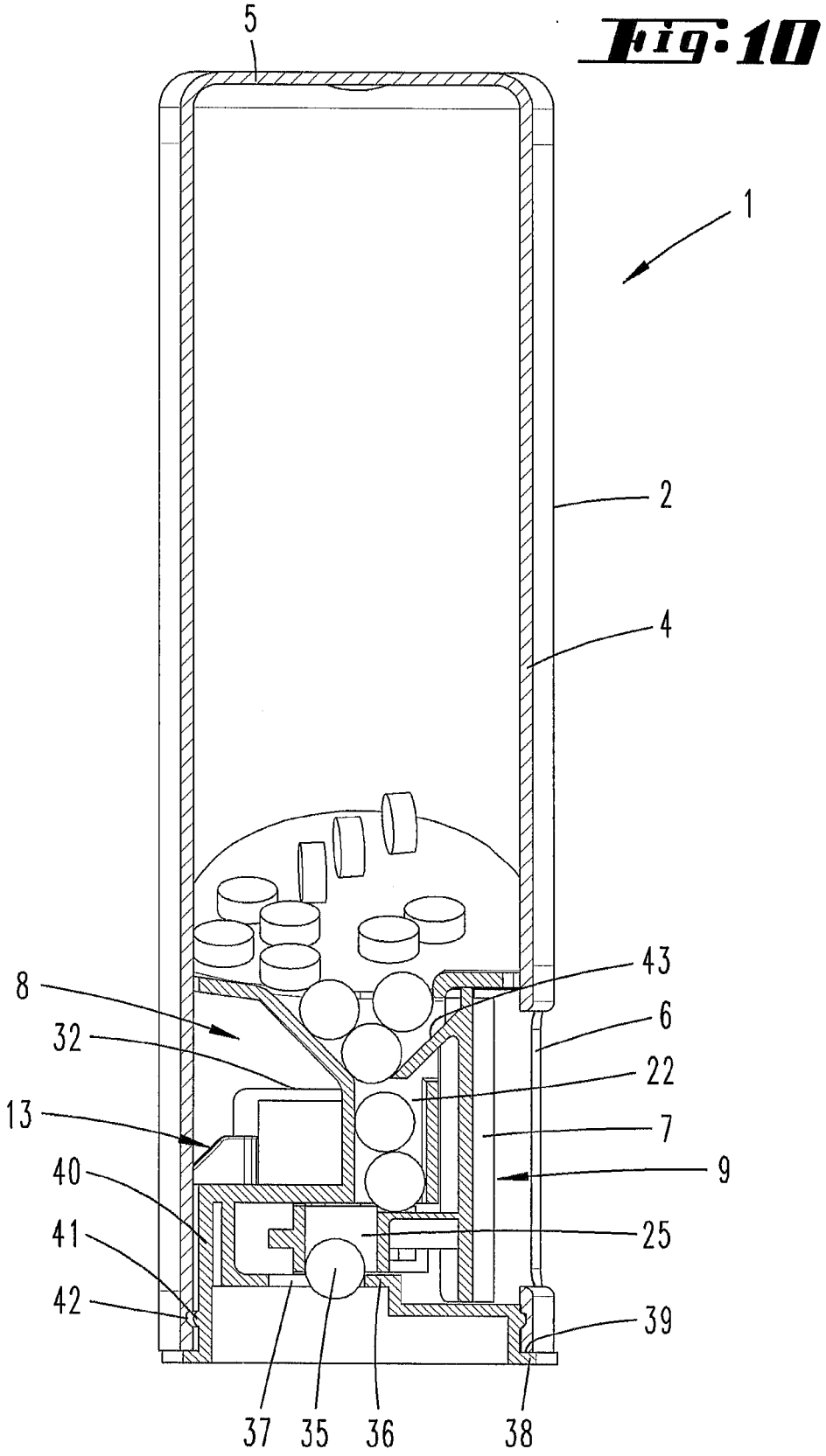
FIG. 10 is a cross section as in FIG. 9, with the dispenser in the actuated position.

The action of tablet dispenser 1 may be discerned by comparing FIGS. 9 and 10. For operation, actuating part 7 is pressed inward relative to the housing by the user, which causes locking part 43 to advance into dispensing chute 22 and push the tablet reserve upward. The tablet for dispensing 35 is already positioned in dispensing aperture 25 of dispensing gate mechanism 24 and is moved by said actuation with dispensing aperture 25, the underside of which is closed off by bottom section 36 in the unactuated position, until it is aligned with dispensing window 37 in the dispensing part and is able to drop out.

If the user removes the pressure on the actuating button, the actuating button is returned from the position shown in FIG. 10 to the position shown in FIG. 9 by the action of return spring 19, whereupon another tablet 35 falls into dispensing aperture 25.

As is also evident, the underside of dispensing part 3 is designed with an enclosing collar 38, which hooks around a bottom frontal face 39 of the housing in the assembled state. Moreover, an engaging bead 41 extends circumferentially around the base of the vertical wall 40 of dispensing part 3, and cooperates with a corresponding recess 42 in the inner surface of housing wall 4 to function as a retainer.

All disclosed features are (separately) essential to the invention. The content of disclosure of the associated/accompanying priority documents (transcript of the prior application) is herewith also incorporated in its entirety in the disclosure of the present application, also for the purpose of including features of said documents in the claims of the present application. The optionally co-ordinated versions of the subordinate claims characterise inventive refinements of the prior art, particularly for the purpose of submitting partial applications based on such claims.

| Key to reference signs |
|---|
| 1 Tablet dispenser |
| 2 Housing |
| 3 Dispensing part |
| 4 Housing wall |
| 5 Housing roof |
| 6 Actuating window |
| 7 Actuating part |
| 7a Actuating surface |
| 8 Subsection |
| 9 Subsection |
| 10 Hinge connection |
| 11 Engaging lug |
| 12 Detent aperture |
| 13 Tensioning part |
| 14 Hinge area |
| 15 Predetermined breaking point |
| 16 Protruding area |
| 17 Housing edge |
| 18 Introduction area |
| 19 Return spring |
| 20 End |
| 21 Extension wall (partition) |
| 22 Dispensing chute |
| 23 Cam section |
| 24 Dispensing gate mechanism |
| 25 Dispensing aperture |
| 26 Closing section |
| 27 Surface |
| 28 Bottom |
| 29 Window |
| 30 Housing section |
| 31 Housing section |
| 32 Roof section |
| 33 Inner surface |
| 34 Chamber |
| 35 Tablet |
| 36 Bottom |
| 37 Dispensing window |
| 38 Enclosing collar |
| 39 Frontal face |
| 40 Vertical wall |
| 41 Engaging bead |
| 42 Recess |
| 43 Closing part |
| 44 Metering part |

The invention claimed is:

1. A method for constructing a tablet dispenser for metered dispensing of a tablet, having a housing and a dispensing part that is insertable in the housing into an assembled position within the housing, wherein the dispensing part comprises a return spring, a dispensing chute, and a metering part that is movable relative to the dispensing chute against the force of the return spring, wherein the dispensing part further comprises a tensioning part that is moved into an area previously occupied by the unbiased return spring such that pretension is generated in the return spring as the dispensing part is inserted in the housing, the tensioning part having a first side and a second side opposite to the first side, wherein the return spring is under prestress in both a dispensing condition and in a non-dispensing condition due to the tensioning part being moved into the area previously occupied by the unbiased return spring when the dispensing part is inserted in the housing, wherein the return spring is disposed within the housing when the dispensing part has been inserted in the housing, and wherein when the tablet dispenser is in the assembled position and in the non-dispensing condition, the first side of the tensioning part is engaged by the return spring and the second side of the tensioning part is engaged by an inner surface of the housing;

wherein the tensioning part being combined in a non-assembled condition with a remaining part by a disruption area having a predetermined breaking point and further by a hinge area, wherein after the insertion of the dispensing part into the housing the tensioning part remains in a tensioning position by a non-returnable detent;

wherein the return spring in the non-assembled condition already is housed into a hidden position by means of a cage structure and wherein an underside of the tensioning part is shielded by a bottom, that a lateral side of the return spring is shielded by an actuating part on one side and the tensioning part on the other side, and that there are housing sections and a roof area shielding the tensioning part in this condition as well.

2. The method according to claim 1, wherein prior to the dispensing part being inserted into the housing the dispensing part and the housing are in an unassembled position, and wherein in the unassembled position the return spring of the dispensing part is disposed at a distance from the tensioning part of the dispensing part.

3. The method according to claim 1, wherein the dispensing part is a two-part member comprising a first subsection and a second subsection, and wherein prior to the dispensing part being inserted into the housing, the dispensing part is assembled by interlocking the first subsection to the second subsection.

4. The method according to claim 3, wherein prior to the dispensing part being inserted into the housing the dispensing part and the housing are in an unassembled position, and wherein in the unassembled position and when the first subsection of the dispensing part is interlocked to the second subsection of the dispensing part the return spring of the dispensing part is disposed at a distance from the tensioning part of the dispensing part.

5. A tablet dispenser for dispensing individual tablets, having a housing and a dispensing part that is insertable in the housing into an assembled position within the housing, wherein the dispensing part has a dispensing chute and a metering part arranged movably therein, wherein further the metering part is movable against the force of a return spring arranged inside the dispensing part, wherein the dispensing part further has a tensioning part which is movable into an area previously occupied by the unbiased return spring such that pretension is generated in the return spring as the dispensing part is inserted in the housing, the tensioning part having a first side and a second side opposite to the first side, wherein the return spring is under prestress in both a dispensing condition and in a non-dispensing condition due to the tensioning part being moved into the area previously occupied by the unbiased return spring when the dispensing part is inserted in the housing, wherein the return spring is disposed within the housing when the dispensing part has been inserted in the housing, wherein when the tablet dispenser is in the assembled position and in the non-dispensing condition, the first side of the tensioning part is engaged by the return spring and the second side of the tensioning part is engaged by an inner surface of the housing;

wherein the tensioning part being combined in a non-assembled condition with a remaining part by a disruption area having a predetermined breaking point and further by a hinge area;

wherein after the insertion of the dispensing part into the housing the tensioning part remains in a tensioning position, by a non-returnable detent;

wherein the return spring in the non-assembled condition already is housed into a hidden position by means of a cage structure, and wherein an underside of the tensioning part is shielded by a bottom, that a lateral side of the return spring is shielded by an actuating part on one side and the tensioning part on the other side, and that there are housing sections and a roof area shielding the tensioning part in this condition as well.

6. The tablet dispenser according to claim 5, wherein the tensioning part is in a position ready to operate of the dispenser shifted against a movement tendency of the return spring during a dispensing operation.

7. The tablet dispenser according to claim 5, wherein the dispensing chute extends essentially vertically.

8. The tablet dispenser according to claim 5, wherein the tensioning part is connected to the dispensing part via a breaking point.

9. The tablet dispenser according to claim 5, wherein the tensioning part is connected to the dispensing part via a hinge area.

10. The tablet dispenser according to claim 5, wherein the dispensing part is constructed as a single-part plastic injection molded component.

11. The tablet dispenser according to claim 5, wherein the dispensing part has two subsections, which are connected to one another in hinged manner, and wherein one subsection includes the tensioning part, and the other subsection includes the metering part and the return spring.

12. The tablet dispenser according to claim 5, wherein the dispensing part comprises a layout that matches an interior free cross section of the housing, and wherein the tensioning part projects beyond the layout.

13. The tablet dispenser according to claim 5, wherein the housing has an oval interior free cross section.

14. The tablet dispenser according to claim 5, wherein in an unassembled position the dispensing part is not inserted into the housing, and wherein in the unassembled position the return spring arranged inside the dispensing part is disposed at a distance from the tensioning part of the dispensing part.

15. A method for constructing a tablet dispenser for metered dispensing of a tablet, having a housing and a dispensing part that is insertable in the housing into an assembled position within the housing, wherein the dispensing part comprises a return spring, a dispensing chute, and a metering part that is movable relative to the dispensing chute against the force of the return spring, wherein the dispensing part further comprises a tensioning part that is moved into an area previously occupied by the unbiased return spring such that pretension is generated in the return spring as the dispensing part is inserted in the housing, the tensioning part having a first side and a second side opposite to the first side, wherein the return spring is under prestress in both a dispensing condition and in a non-dispensing condition due to the tensioning part being moved into the area previously occupied by the unbiased return spring when the dispensing part is inserted in the housing, wherein the return spring is disposed within the housing when the dispensing part has been inserted in the housing, and wherein when the tablet dispenser is in the assembled position and in the non-dispensing condition, the first side of the tensioning part is engaged by the return spring and the second side of the tensioning part is engaged by an inner surface of the housing;

wherein the tensioning part being combined in a non-assembled condition with a remaining part by a disruption area having a predetermined breaking point and further by a hinge area, wherein after the insertion of the dispensing part into the housing the tensioning part remains in a tensioning position by a non-returnable detent;

wherein the return spring in the non-assembled condition already is housed into a hidden position by means of a cage structure and wherein an underside of the tensioning part is shielded by a bottom, that a lateral side of the return spring is shielded by an actuating part on one side and the tensioning part on the other side, and that there are housing sections and a roof area shielding the tensioning part in this condition as well;

wherein said first side of said tensioning part (13) is an inner surface (33) which cooperates with a free end (20) of said return spring (19); said tensioning part (13) being within said cage structure (34);

wherein said second side of said tensioning part (13) has multiple protruding areas (16) on said second side; and wherein said multiple protruding areas (16) contact an enclosing collar (38) of the housing;

said protruding areas (16) are on ribs that protrude outwardly toward the enclosing collar in the assembled state; said ribs have an introduction area (18) on top, which functions as an insertion bevel and enables deflection during assembly.

16. A tablet dispenser for dispensing individual tablets, having a housing and a dispensing part that is insertable in the housing into an assembled position within the housing, wherein the dispensing part has a dispensing chute and a metering part arranged movably therein, wherein further the metering part is movable against the force of a return spring arranged inside the dispensing part, wherein the dispensing part further has a tensioning part which is movable into an area previously occupied by the unbiased return spring such that pretension is generated in the return spring as the dispensing part is inserted in the housing, the tensioning part having a first side and a second side opposite to the first side, wherein the return spring is under prestress in both a dispensing condition and in a non-dispensing condition due to the tensioning part being moved into the area previously occupied by the unbiased return spring when the dispensing part is inserted in the housing, wherein the return spring is disposed within the housing when the dispensing part has been inserted in the housing, wherein when the tablet dispenser is in the assembled position and in the non-dispensing condition, the first side of the tensioning part is engaged by the return spring and the second side of the tensioning part is engaged by an inner surface of the housing;

wherein the tensioning part being combined in a non-assembled condition with a remaining part by a disruption area having a predetermined breaking point and further by a hinge area;

wherein after the insertion of the dispensing part into the housing the tensioning part remains in a tensioning position, by a non-returnable detent;

wherein the return spring in the non-assembled condition already is housed into a hidden position by means of a cage structure, and wherein an underside of the tensioning part is shielded by a bottom, that a lateral side of the return spring is shielded by an actuating part on one side and the tensioning part on the other side, and that there are housing sections and a roof area shielding the tensioning part in this condition as well;

wherein said first side of said tensioning part (13) is an inner surface (33) which cooperates with a free end (20) of said return spring (19); said tensioning part (13) being within said cage structure (34);

wherein said second side of said tensioning part (13) has multiple protruding areas (16) on said second side; and wherein said multiple protruding areas (16) contact an enclosing collar (38) of the housing;

said protruding areas (16) are on ribs that protrude outwardly toward the enclosing collar in the assembled state; said ribs have an introduction area (18) on top, which functions as an insertion bevel and enables deflection during assembly.

17. A method for constructing a tablet dispenser for metered dispensing of a tablet, having a housing and a dispensing part that is insertable in the housing into an assembled position within the housing, wherein the dispensing part comprises a return spring, a dispensing chute, and a metering part that is movable relative to the dispensing chute against the force of the return spring, wherein the dispensing part further comprises a tensioning part that is moved into an area previously occupied by the unbiased return spring such that pretension is generated in the return spring as the dispensing part is inserted in the housing, the tensioning part having a first side and a second side opposite to the first side, wherein the return spring is under prestress in both a dispensing condition and in a non dispensing condition due to the tensioning part being moved into the area previously occupied by the unbiased return spring when the dispensing part is inserted in the housing, wherein the return spring is disposed within the housing when the dispensing part has been inserted in the housing, and wherein when the tablet dispenser is in the assembled position and in the non-dispensing condition, the first side of the tensioning part is engaged by the return spring and the second side of the tensioning part is engaged by an inner surface of the housing;

wherein the tensioning part being combined in a non-assembled condition with a remaining part by a hinge area, wherein after the insertion of the dispensing part into the housing the tensioning part remains in a tensioning position by a non-returnable detent;

wherein the return spring in the non-assembled condition already is housed into a hidden position by means of a cage structure and wherein an underside of the tensioning part is shielded by a bottom, that a lateral side of the return spring is shielded by an actuating part on one side and the tensioning part on the other side, and that there are housing sections and a roof area shielding the tensioning part in this condition as well.

18. A tablet dispenser for dispensing individual tablets, having a housing and a dispensing part that is insertable in the housing into an assembled position within the housing, wherein the dispensing part has a dispensing chute and a metering part arranged movably therein, wherein further the metering part is movable against the force of a return spring arranged inside the dispensing part, wherein the dispensing part further has a tensioning part which is movable into an area previously occupied by the unbiased return spring such that pretension is generated in the return spring as the dispensing part is inserted in the housing, the tensioning part having a first side and a second side opposite to the first side, wherein the return spring is under prestress in both a dispensing condition and in a non-dispensing condition due to the tensioning part being moved into the area previously occupied by the unbiased return spring when the dispensing part is inserted in the housing, wherein the return spring is disposed within the housing when the dispensing part has been inserted in the housing, wherein when the tablet dispenser is in the assembled position and in the non-dispensing condition, the first side of the tensioning part is engaged by the return spring and the second side of the tensioning part is engaged by an inner surface of the housing;

wherein the tensioning part being combined in a non-assembled condition with a remaining part by a hinge area;

wherein after the insertion of the dispensing part into the housing the tensioning part remains in a tensioning position, by a non-returnable detent;

wherein the return spring in the non-assembled condition already is housed into a hidden position by means of a cage structure, and wherein an underside of the tensioning part is shielded by a bottom, that a lateral side of the return spring is shielded by an actuating part on one side and the tensioning part on the other side, and that there are housing sections and a roof area shielding the tensioning part in this condition as well.

19. A method for constructing a tablet dispenser for metered dispensing of a tablet, having a housing and a dispensing part that is insertable in the housing into an assembled position within the housing, wherein the dispensing part comprises a return spring, a dispensing chute, and a metering part that is movable relative to the dispensing chute against the force of the return spring, wherein the dispensing part further comprises a tensioning part that is moved into an area previously occupied by the unbiased return spring such that pretension is generated in the return spring as the dispensing part is inserted in the housing, the tensioning part having a first side and a second side opposite to the first side, wherein the return spring is under prestress in both a dispensing condition and in a non-dispensing condition due to the tensioning part being moved into the area previously occupied by the unbiased return spring when the dispensing part is inserted in the housing, wherein the return spring is disposed within the housing when the dispensing part has been inserted in the housing, and wherein when the tablet dispenser is in the assembled position and in the non-dispensing condition, the first side of the tensioning part is engaged by the return spring and the second side of the tensioning part is engaged by an inner surface of the housing;

wherein the tensioning part being combined in a non-assembled condition with a remaining part by a hinge area, wherein after the insertion of the dispensing part into the housing the tensioning part remains in a tensioning position by a non-returnable detent;

wherein the return spring in the non-assembled condition already is housed into a hidden position by means of a cage structure and wherein an underside of the tensioning part is shielded by a bottom, that a lateral side of the return spring is shielded by an actuating part on one side and the tensioning part on the other side, and that there are housing sections and a roof area shielding the tensioning part in this condition as well;

wherein said first side of said tensioning part (13) is an inner surface (33) which cooperates with a free end (20) of said return spring (19); said tensioning part (13) being within said cage structure (34);

wherein said second side of said tensioning part (13) has multiple protruding areas (16) on said second side; and wherein said multiple protruding areas (16) contact an enclosing collar (38) of the housing;

said protruding areas (16) are on ribs that protrude outwardly toward the enclosing collar in the assembled position; said ribs have an introduction area (18) on top, which functions as an insertion bevel and enables deflection during assembly.

20. A tablet dispenser for dispensing individual tablets, having a housing and a dispensing part that is insertable in the housing into an assembled position within the housing, wherein the dispensing part has a dispensing chute and a metering part arranged movably therein, wherein further the metering part is movable against the force of a return spring arranged inside the dispensing part, wherein the dispensing part further has a tensioning part which is movable into an area previously occupied by the unbiased return spring such that pretension is generated in the return spring as the dispensing part is inserted in the housing, the tensioning part having a first side and a second side opposite to the first side, wherein the return spring is under prestress in both a dispensing condition and in a non-dispensing condition due to the tensioning part being moved into the area previously occupied by the unbiased return spring when the dispensing part is inserted in the housing, wherein the return spring is disposed within the housing when the dispensing part has been inserted in the housing, wherein when the tablet dispenser is in the assembled position and in the non-dispensing condition, the first side of the tensioning part is engaged by the return spring and the second side of the tensioning part is engaged by an inner surface of the housing;

wherein the tensioning part being combined in a non-assembled condition with a remaining part by a hinge area;

wherein after the insertion of the dispensing part into the housing the tensioning part remains in a tensioning position, by a non-returnable detent;

wherein the return spring in the non-assembled condition already is housed into a hidden position by means of a cage structure, and wherein an underside of the tensioning part is shielded by a bottom, that a lateral side of the return spring is shielded by an actuating part on one side and the tensioning part on the other side, and that there are housing sections and a roof area shielding the tensioning part in this condition as well;

wherein said first side of said tensioning part (13) is an inner surface (33) which cooperates with a free end (20) of said return spring (19); said tensioning part (13) being within said cage structure (34);

wherein said second side of said tensioning part (13) has multiple protruding areas (16) on said second side; and wherein said multiple protruding areas (16) contact an enclosing collar (38) of the housing;

said protruding areas (16) are on ribs that protrude outwardly toward the enclosing collar in the assembled position; said ribs have an introduction area (18) on top, which functions as an insertion bevel and enables deflection during assembly.

* * * * *